US005757347A

United States Patent [19]

Han

[11] Patent Number: 5,757,347

[45] **Date of Patent: *May 26, 1998**

[54] PROCESS FOR PRODUCING SHADED COLORED IMAGES USING DITHERING TECHNIQUES

[75] Inventor: Robin S. Han, Saratoga, Calif.

[73] Assignee: Cirrus Logtic, Inc., Fremont, Calif.

[ * ] Notice: The term of this patent shall not extend beyond the expiration date of Pat. No. 5,748,163.

[21] Appl. No.: 61,802

[22] Filed: May 17, 1993

Related U.S. Application Data

[63] Continuation-in-part of Ser. No. 813,036, Dec. 24, 1991, abandoned.

[51] Int. Cl.[6] ..... G09G 3/36

[52] U.S. Cl. ..... 345/88; 345/89; 345/148; 345/149

[58] Field of Search ..... 358/455, 429; 382/54, 169; 345/89, 88, 113, 136, 139, 147, 148, 149, 150, 152, 153

[56] References Cited

U.S. PATENT DOCUMENTS

| | | | |
|---|---|---|---|
| 3,716,658 | 2/1973 | Rackman | 178/7.3 D |
| 3,735,182 | 5/1973 | Dalton . | |

(List continued on next page.)

FOREIGN PATENT DOCUMENTS

| | | | |
|---|---|---|---|
| 0 193 728 A2 | 1/1986 | European Pat. Off. | G09G 3/20 |
| 0 271 960 | 12/1986 | European Pat. Off. . | |
| 0 364 307 | 4/1990 | European Pat. Off. . | |
| 0 387 033 | 9/1990 | European Pat. Off. | 345/149 |
| 3906924 A1 | 3/1989 | Germany | G09G 3/20 |
| 58-220181 | 12/1983 | Japan . | |
| 58-220182 | 12/1983 | Japan . | |
| 58-220183 | 12/1983 | Japan . | |
| 2 204 174 A | 11/1988 | United Kingdom . | |
| WO90/12388 | 10/1990 | WIPO . | |

OTHER PUBLICATIONS

Maltese, Paolo et al., "Addressing Cycles for Fast Setting Grey Shades in Ferroelectric Liquid Crystal Matrics", Ferroelectrics, 1988, vol. 85, pp. 265–274.

Witten, Ian H. et al., "Using Peano Curves for Bilevel Display of Continuous–Tone Images", IEEE Computer Graphics and applications, vol. 2, No. 3, May 1982, pp. 47–51.

"New Technologies Sharpen Laptop Displays," International Electronic Design, Feb. 1989, pp. 45–48.

P. 38, Technical Manual, SED 1341 $F_{OE}$, 1988, SMOS Systems, Inc.

S–MOS Systems, Inc. sales brochure for "Dragon Graphic Chip Sets" (Preliminary), undated.

*Primary Examiner*—Steven Saras

*Attorney, Agent, or Firm*—Burns, Doane, Swecker & Mathis; Alan S. Hodes; Steven A. Shaw

[57] ABSTRACT

In a flat-panel display device, the ON/OFF duty cycle of each picture element of the array of picture elements is modulated during a multi-frame display sequence according to attribute information of respective picture element data to be displayed. The timing of ON/OFF and OFF/ON state transitions (i.e., the modulations) of the picture elements are coordinated within predetermined neighborhoods throughout the array of picture elements such that the state transitions occur substantially uniformly in space and time within a display neighborhood during the multi-frame display sequence. Advantage is taken of the visual averaging property by causing state transitions to occur substantially uniformly in space and time within each neighborhood throughout the array of picture elements during a multi-frame display sequence. Individual state transitions, which by themselves constitute display noise, are not perceived; instead, a coherent pattern of state transitions blending is provided that effectively simulates non-monochrome image displays. Dithering techniques are applied to realize a greater number of display colors than would otherwise be possible using conventional color LCD displays.

24 Claims, 6 Drawing Sheets

U.S. PATENT DOCUMENTS 3,937,878 2/1976 Judice .
4,100,579 7/1978 Ernstoff .
4,385,293 5/1983 Wisnieff .
4,390,874 6/1983 Woodside et al. ..... 340/812
4,427,978 1/1984 Williams .
4,427,979 1/1984 Clerc .
4,486,785 12/1984 Lasher .
4,488,150 12/1984 Kanatani .
4,516,118 5/1985 Wahlquist .
4,559,535 12/1985 Watkins .
4,591,848 5/1986 Morozumi .
4,640,582 2/1987 Oguchi .
4,654,721 3/1987 Goertzel .
4,660,030 4/1987 Maezawa .
4,695,884 9/1987 Anastassiou .
4,706,077 11/1987 Robertz et al. ..... 340/793
4,709,995 12/1987 Kuribayashi .
4,742,346 5/1988 Gillette .
4,743,096 5/1988 Wakai .
4,760,387 7/1988 Ishii et al. ..... 340/716
4,769,713 9/1988 Yasui .
4,775,891 10/1988 Aoki .
4,779,083 10/1988 Ishii .
4,791,417 12/1988 Bobak .
4,797,945 1/1989 Suzuki .
4,805,994 2/1989 Miyajima .
4,808,991 2/1989 Tachiuchi .
4,816,816 3/1989 Usui ..... 340/784
4,827,255 5/1989 Ishii .
4,840,460 6/1989 Bernot .
4,860,246 8/1989 Inoue .
4,872,059 10/1989 Shinabe .
4,908,613 3/1990 Green .
4,921,334 5/1990 Akodes .
4,929,058 5/1990 Numao .
4,956,638 9/1990 Larky et al. ..... 340/793
5,006,840 4/1991 Hamada et al. ..... 340/784
5,025,400 6/1991 Cook .
5,068,649 11/1991 Garrett ..... 345/89
5,073,966 12/1991 Sato ..... 358/429
5,111,194 5/1992 Oneda .
5,122,783 6/1992 Bassetti .
5,185,602 2/1993 Bassetti, Jr. et al. ..... 340/793
5,293,159 3/1994 Bassetti, Jr. et al. ..... 345/149
5,298,915 3/1994 Bassetti, Jr. ..... 345/149

PROCESS FOR PRODUCING SHADED COLORED IMAGES USING DITHERING TECHNIQUES

RELATED APPLICATION

The present application is a continuation-in-part of co-pending application Ser. No. 07/813,036 which was filed in the United States Patent and Trademark Office on Dec. 24, 1991, now abandoned, and commonly assigned herewith, the disclosure of which is incorporated herein in its entirety.

FIELD OF THE INVENTION

The present invention generally relates to processes for providing multi-color images on opto-electronic display devices; more particularly, the present invention relates to processes for producing multi-color shaded images that are presented in successive frames of video information on opto-electronic display devices such as flat-panel LCDs (liquid crystal displays) and similar display devices.

STATE OF THE ART

In recent years, the computer industry has given significant attention to laptop computer components and, more particularly, to providing laptop computer components with the same functionality as desktop models. One particular challenge has been the opto-electronic displays, such as flat-panel LCDs (liquid crystal displays) and similar display devices, that are employed with laptop computers. Those displays typically are monochrome, in contrast to the high-resolution grey scale and color displays that are common in CRT (cathode ray tube) type screens. Even the grey scale or color LCDs that are commercially available are quite expensive and, typically, are capable only of displaying a narrow range of shades.

LCDs and other flat panel display devices differ from CRT devices in two important aspects. First, in operation of a CRT device, an electron beam is driven to scan rapidly back and forth across a screen to sequentially energize selected picture-element locations, or "pixels", along the generally horizontal scanning lines; the net effect of a complete raster of scans is to reproduce snapshot-like "frames" that each contain video data as to the state of each pixel location on each scanning line. The horizontal scanning lines are organized by synchronizing signals, with each frame containing several hundred horizontal scan lines. The frames are reproduced at a standard rate; for example, the frame repetition rate might be sixty frames per second.

In operation of LCDs and similar flat panel display devices, there is no back and forth scanning of an electron beam—in fact there is no electron beam. Instead, such display devices employ arrays of shift registers, with the result that locations anywhere on a screen can be illuminated simultaneously—i.e., at exactly the same instant. Nevertheless, in flat panel display devices as in CRT devices that are employed with microprocessor-based computers, video information is still presented in frames. Each frame normally comprises a field which is 640 pixel locations wide by 480 pixel locations high, and the typical frame repetition rate is sixty frames per second (i.e., 60 hertz).

Also, LCDs and similar flat panel display screens, at least those of the passive-matrix type, differ from CRT devices in that the illumination intensity (i.e., brightness) at the pixel locations cannot be varied. Instead, the illumination intensity at pixel locations on a flat panel display screen is either "on" or "off." (For present purposes, a pixel location will be considered "on" when the pixel location is illuminated and, conversely, a pixel location will be considered "off" when it is not illuminated.) Thus, when a flat panel display screen is fully illuminated—that is, each pixel location is in its "on" state—the screen will have uniform brightness. (In the following, the term "binary display device" refers to display devices whose picture elements have only two display states—either an "on" and an "off" state.) A super-twisted nematic (STN) LCD is an example of a passive-matrix LCD.

Because pixel locations of passive-matrix flat panel display screens only have an "on" or "off" state, shading effects cannot be readily produced for images that appear on the screens. To overcome this problem, frame modulation techniques have been employed for simulating grey scale shading of images on binary display devices. Frame modulation techniques basically employ the principal that the frequency with which a pixel location is illuminated determines its perceived brightness and, therefore, its perceived shading. For example, to display a 25% black tone using simple frame modulation, a display element is made active (inactive) in one-quarter of the frames. Similarly, to display a tone of 75% black, a display element would be made active (inactive) in three-quarters of the frames. Thus, frame modulation techniques are based upon the principle that, for a picture element having only an active state and an inactive state, when the picture element is made active (or inactive) in a certain fraction of successive frames occurring within a short period of time, the human eye will perceive the picture element as having a tone which is intermediate to tones that are presented when the display element were constantly active (or constantly inactive). The intermediate tones are determined by the percentage of frames in which the display element is active (inactive). Accordingly, when modulation is performed over a sixteen-frame period, then sixteen different tones are simulated.

In summary, it can be said that frame modulation techniques take advantage of persistence and averaging properties of human vision according to which a display element turned on and off at a sufficiently rapid rate is perceived as being continually on and as having a display intensity proportional to the on/off duty cycle of the display element. In conventional practice, frame modulation techniques for producing shading on binary display devices tend to create displays in which the human eye detects considerable turbulence or "display noise".

Unlike passive-matrix LCDs, active matrix LCDs allow brightness of the pixel locations to be varied. A thin-film transistor (TFT) LCD is an example of an active-matrix LCD. Located at each pixel location is a transistor that may be turned on to various degrees, in turn creating an electric field of varying degrees of intensity to cause the corresponding LCD cell to pass or block light in varying degrees, resulting in different perceived brightnesses. TFT LCD displays are costly and have thus far offered only a limited number of display shades. A typical TFT LCD color display, for example, might support eight shades each of red, green and blue for a total of 512 possible colors.

An object of the present invention is to simulate display colors in addition to a number of display colors otherwise available using a conventional color display apparatus in such a manner as to achieve a smooth display absent the image turbulence and display noise experienced in the prior art. The invention is particularly applicable to passive-matrix super-twisted nematic (STN) and active-matrix thin-film-transistor (TFT) color LCD displays.

SUMMARY OF THE INVENTION

The present invention, generally speaking, relates to processes for producing shading in multi-color images that are presented in successive frames of video information on flat-panel LCD (liquid crystal diode) displays and similar display devices while reducing display noise to a minimum. More particularly, the present invention provides a method for simulating various color shades in images on display devices (e.g., STN color LCD displays) that have an array of picture elements each having only two display states, an ON state and an OFF state, and on display devices (e.g., TFT color LCD displays) that have more than two display states.

According to the method of the present invention, the ON/OFF duty cycle of each picture element of the array of picture elements is modulated during a multi-frame display sequence according to attribute information of respective picture element data to be displayed. The timing of ON/OFF and OFF/ON state transitions (i.e., the modulations) of the picture elements are coordinated within predetermined neighborhoods throughout the array of picture elements such that the state transitions occur substantially uniformly in space and time within a display neighborhood during the multi-frame display sequence. Accordingly, the present invention takes further advantage of the visual averaging property by causing state transitions to occur substantially uniformly in space and time within each neighborhood throughout the array of picture elements during a multi-frame display sequence. In use of the present invention, individual state transitions, which by themselves constitute display noise, are not perceived; instead, a coherent pattern of state transitions blending is provided that effectively simulates non-monochrome image displays.

Further in accordance with the present invention, dithering techniques are applied to realize a greater number of display colors than would otherwise be possible using conventional color LCD displays.

In a preferred embodiment, the present invention provides a method of simulating display colors in addition to a number of display colors normally available using a color display apparatus such as a TFT color LCD display. In such a display, each of an array of picture elements includes plural picture sub-elements each of a different color (for example, red, green and blue). Furthermore, each picture sub-element has more than two display states selected between using at least two input terminals, each of which has two possible inputs, an ON input and an OFF input. For example, in the case of a picture element having a red, a green and a blue picture sub-element, each picture sub-element might have three input terminals and eight possible display states corresponding to different color shades. By modulating an ON/OFF duty cycle of a least significant one of the input terminals of each picture sub-element of the array of picture elements during a multi-frame display sequence, a greater number of display colors may be realized than would otherwise be possible. Using a multi-frame sequence 16 frames in duration, the least significant input terminal alone may be controlled to realize 16 display colors, at a single picture sub-element and in combination with the two more significant terminals may be used to realize 64 colors at a single picture sub-element. Using dithering, that number may be further increased by a factor of four. Preferably, a multi-frame sequence 64 frames in duration is logically divided into four sub-sequences each 16 frames in duration with the duty cycle of each picture sub-element (controlled using the least significant input terminal) being constrained to assume one of two adjacent values only such that display noise is minimized. Using dithering, 256 colors may be realized at a single picture sub-element, such that any given picture element may assume any one of $256^3$ or over 16 million colors. That is, a multi-frame sequence M×N frames in duration is logically divided into M (e.g. 4) sub-sequences each N (e.g. 16) frames in duration with the duty cycle of each picture sub-element during each of the M N-frame subseqeuences being allowed to assume one of two adjacent values only.

BRIEF DESCRIPTION OF THE DRAWINGS

The present invention can be further understood with reference to the following description in conjunction with the appended drawings. In the drawings:

FIG. 2(*b*) shows the display neighborhood in greater detail in the case of a color display in which each pixel location has a red, a green and a blue illumination element;

DETAILED DESCRIPTION OF THE PREFERRED EMBODIMENTS

Figure 1:
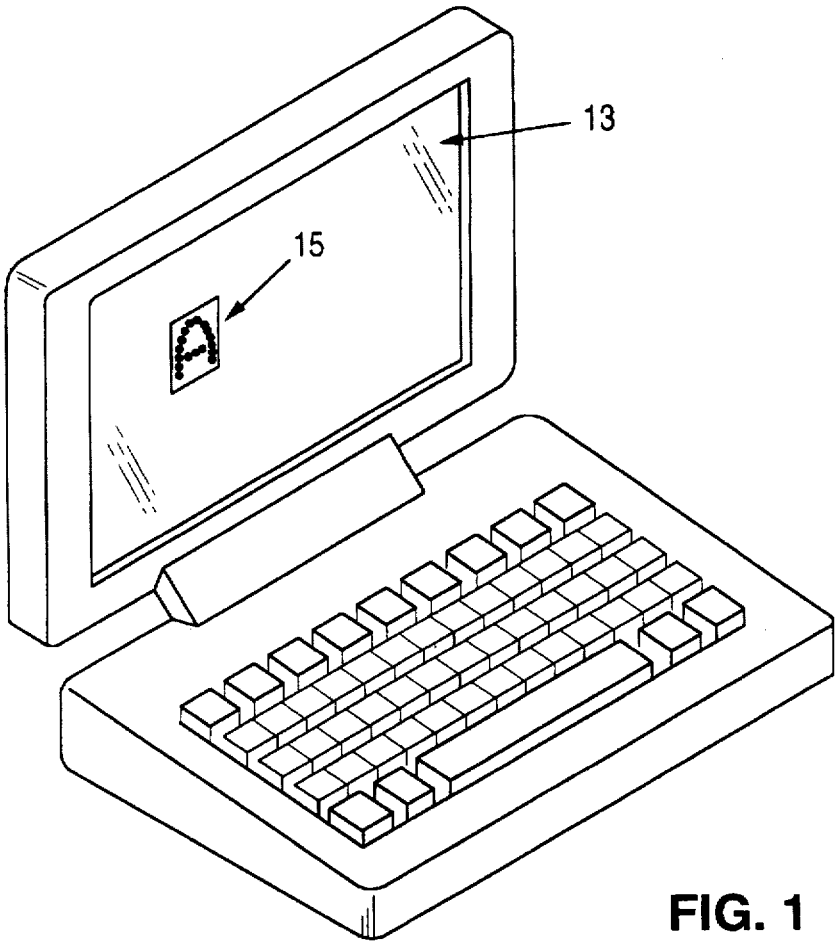
FIG. 1 is a pictorial representation of a display screen having an image field.

FIG. 1 shows an image field 13 on the display screen of a flat-panel LCD (liquid crystal display) display or similar display device. To produce shading in images that are presented in successive frames of video information on such display screens, the image field is subdivided into two-dimensional, uniformly-sized display neighborhoods, such as will be discussed below in conjunction with FIGS. 2–5.

Figure 2A:
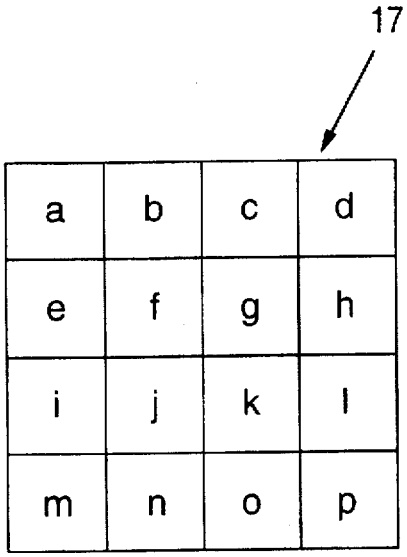
FIG. 2(*a*) shows a display neighborhood of the image field of the display screen of FIG. 1, with the display neighborhood being drawn to a highly enlarged scale for purpose of convenience in describing the process of the present invention.
Figure 2B:
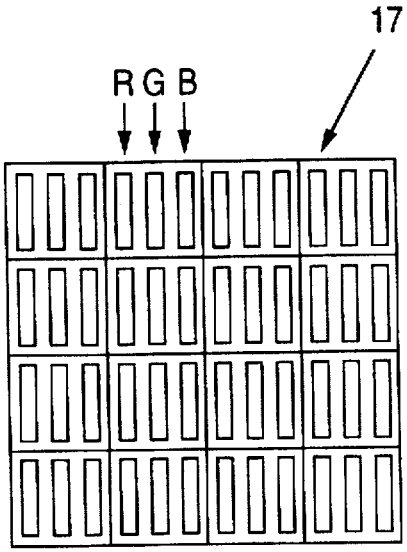

For convenience of discussion, the display neighborhood 17 in FIG. 2(*a*) will be assumed to be four pixels wide by four pixels high; in other words, display neighborhood 17 is a square that encompasses sixteen pixel locations. Also for convenience of discussion, the sixteen pixel locations in display neighborhood 17 are labelled as locations "a" through "p". In the case of color displays, the illumination elements at the pixel locations are grouped as sets of red, green and blue illumination elements (or picture sub-elements). In other words, at each pixel location, there is one red illumination element, one green illumination element, and one blue illumination element as shown in FIG. 2(*b*).

Figure 3:
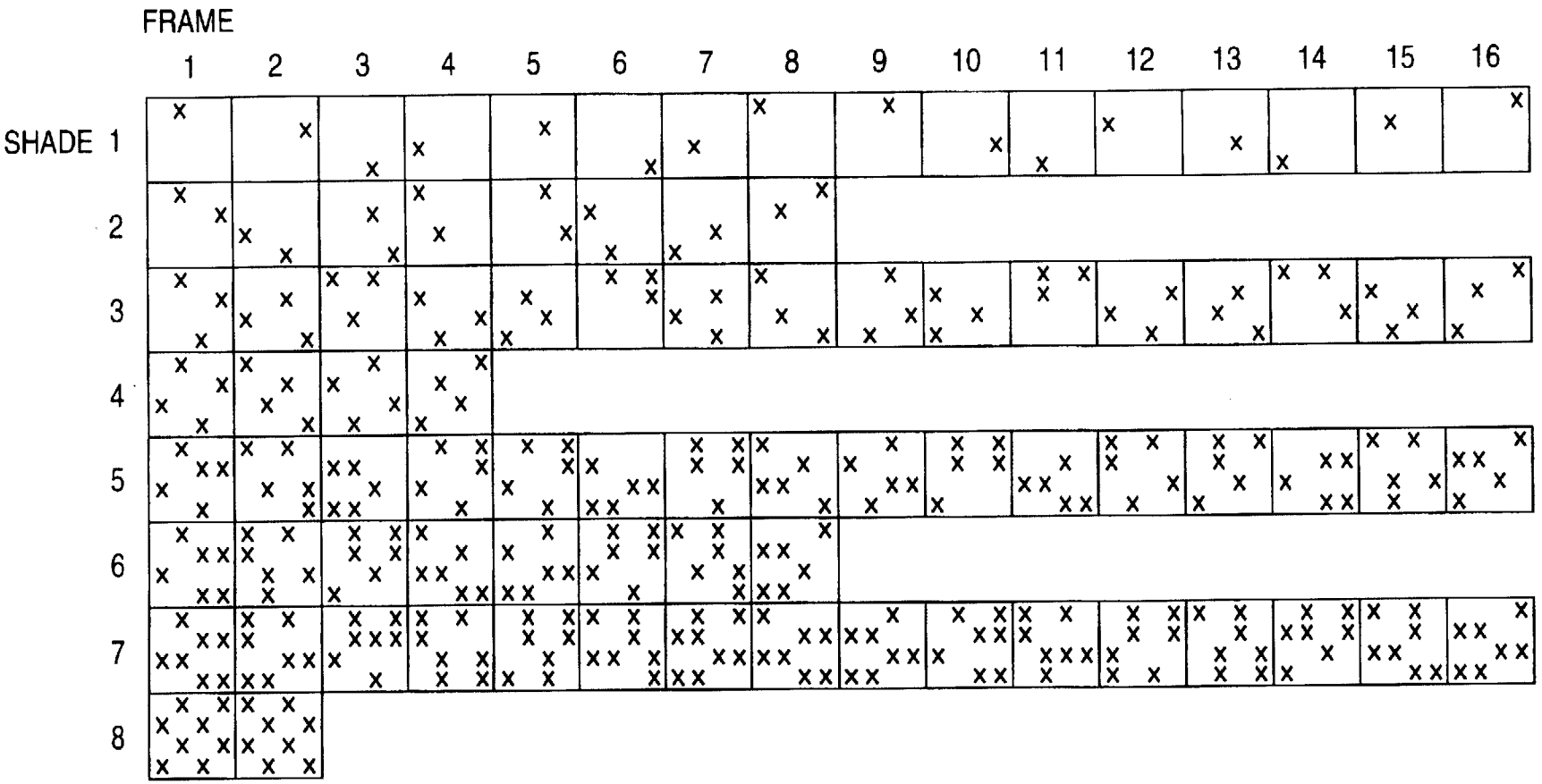
FIG. 3 shows an example of a look-up table for determining the frame sequence for illuminating a given pixel location in the display neighborhood in FIG. 2(*a*)

FIG. 3 shows an example of a look-up table for determining a temporal pattern, or frequency, for illuminating the pixel locations in the display neighborhood 17 in order to produce a selected shade or color. In the following the temporal pattern over which a given illumination element at a pixel location is illuminated is expressed in terms of a "frame sequence;" thus, the number of times that a given illumination element at a pixel location is illuminated will determine its brightness and, therefore, will create an appearance of its shade or color relative to other pixel locations.

As will now be explained the look-up table in FIG. 3 is used in conjunction with a frame modulation process whereby the frequency with which a pixel location is illuminated will determine its perceived brightness and, therefore, its shading or color. For example, if all three illumination elements at pixel location "a" in FIG. 2(*a*) are illuminated simultaneously but only once over a sequence of sixteen frames, that pixel location will appear as a dark shade relative to other pixel locations that are illuminated more frequently over the same frame sequence. So, if all three illumination elements at pixel location "e" are simultaneously illuminated three times over a sequence of sixteen frames, that pixel location will appear as a lighter shade (brighter) relative to pixel location "a." Likewise, if all three illumination elements at pixel location "b" are simultaneously illuminated four times over a sequence of sixteen frames, that pixel location will appear as a still lighter shade relative to pixel locations "a" and "e." In practice, it is convenient to employ a frame sequence that comprises sixteen frames with the frame sequence being repeated between sixty and one-hundred-thirty times per second.

In the look-up table in FIG. 3, the vertical axis indicates shading, from light to dark, over sixteen different shades. The upper rows of the look-up table, therefore, show pixel illumination patterns that provide the appearance of lighter shades; conversely the pixel illumination patterns in the lower rows of the look-up table provide the appearance of darker shades. For purposes of the following discussion, the lightest shade will be referred to as shade #1, the next lightest shade will be referred to as shade #2, and so forth.

The horizontal axis in the look-up table in FIG. 3 indicates the frame number. So, for a sixteen-frame sequence the first column in the table represents the first frame of the sequence, the second column represents the second frame of the sequence, and so forth.

Each square area in the look-up table in FIG. 3 shows the state of the illumination elements at the pixel locations in the display neighborhood for a selected shading at a given frame number. For example, the look-up table indicates that shade #1 is produced at pixel location "a" by illuminating the illumination elements at that pixel location only during the eighth frame of the sequence of sixteen frames. Similarly, the look-up table indicates that shade #1 is produced at pixel location "f" by illuminating the illumination elements at that pixel location only during the fifteenth frame of the sixteen-frame sequence. Or, shade #1 is produced at pixel location "d" by illuminating the illumination elements at that pixel location only during the sixteenth frame.

As still another example, the look-up table in FIG. 3 indicates that shade #3 is produced at pixel location "e" by simultaneously illuminating the illumination elements at that pixel location during the fourth, ninth, and fourteenth frames of the sixteen-frame sequence. Still further, the look-up table indicates that shade #4 is produced at pixel location "b" by illuminating the illumination elements at that pixel location during the first, fifth, ninth and thirteenth frames of the sixteen-frame sequence. Thus, for this example, pixel location "e" will appear lighter than pixel location "a," and pixel location "b" will appear as a still lighter—and this is a result of the fact that the illumination elements at pixel location "a" illuminated once in the sixteen-frame sequence, while the illumination elements at pixel location "c" are illuminated three times in the sixteen-frame sequence, and the illumination elements at picture location "b" are illuminated four times in the sixteen-frame sequence. The limit, obviously, is to illuminate the illumination elements at a pixel location sixteen times in the sixteen-frame sequence.

It will be evident to one of ordinary skill in the art that the illumination elements of a given picture element need not be illuminated at the same frequency. Rather, frame modulation of each of the illumination elements may be controlled separately to realize different colors. For example, the red illumination element of a given picture element may be illuminated eight times in a sixteen-frame sequence, the blue illumination element illuminated four times, and the green illumination element not illuminated at all. Using a sixteen-frame sequence, a total of $16^3$ or 4096 different illumination sequences are possible at a given pixel location for a total of 4096 possible colors. The look-up table of FIG. 3 is thus applied separately to each illumination element to cause each illumination element to display a specified shade of red, green or blue, the shades of the illumination elements of a given picture element being coordinated to produce a given color at that picture element.

Furthermore, the time of ON/OFF and OFF/ON state transitions of illumination elements of a given color are coordinated such that state transitions occur substantially uniformly in space and time within a display neighborhood during the multi-frame display sequence. More particularly, as a general rule, adjacent pixel sub-elements that have the same shade within any one of the display neighborhoods are illuminated with different temporal patterns over a frame sequence as may be seen upon examination of the look-up table in FIG. 3. Thus, continuing with the example above for producing shade #1, the look-up table indicates that the illumination element at pixel location "a" is illuminated only during the eighth frame of the sixteen-frame sequence and that the illumination element at pixel location "b" is illuminated only during the first frame of the sequence. Similarly, for producing shade #3, the look-up table indicates that the illumination element at pixel location "e" is illuminated during the fourth, tenth, and fifteenth frames of the sixteen-frame sequence and that pixel location "a" is illuminated during the third, eighth and fourteenth frames to produce the same shade.

The conditions under which a given display neighborhood is to be uniformly shaded a single color (red, green or blue) can now be readily understood from the look-up table in FIG. 3. For instance, if an entire display neighborhood is to have red shade #3, the look-up table shows that the red pixel sub-elements at the three pixel locations "b", "h" and "o" are to be illuminated during the first frame of the sixteen-frame sequence; that the red pixel sub-elements at the three pixel locations "g," "i" and "p" are to be illuminated during the second frame; that the red pixel sub-elements at the pixel locations "a," "c," and "j" are to be illuminated during the third frame; and so forth. According to this example, a display neighborhood can have any one of sixteen different shades of a given color and, therefore, it can be understood that the look-up table in FIG. 3 provides an entire frame modulation sequence for each of a number of color shades within a display neighborhood.

It should be understood that the illumination conditions described in the preceding paragraph can be accomplished by simultaneously illuminating all three illumination elements at each of the pixel locations. In other words, if all of the picture sub-elements of any given color in a display neighborhood are illuminated at the same frequency (but preferably not at the same phase to reduce display noise), then a uniform color will be displayed in the display neighborhood. Also, the conditions described in the preceding paragraph can be accomplished by selecting only one of the illumination elements for illumination, as long as the same color element is always selected. For instance, if an entire display neighborhood is to have shade "green #3," the green illumination elements at the three pixel locations "b", "h" and "o" are illuminated during the first frame of the sixteen-frame sequence; then, the green illumination elements at the three pixel locations "g," "i" and "p" are illuminated during the second frame; next, the green illumination elements at the pixel locations "a," "c," and "j" are illuminated during the third frame; and so forth. An entirely different—and probably unwanted—effect would result from, for instance, illuminating the green illumination elements at the three pixel locations "b", "h" and "o" during the first frame of the sixteen-frame sequence and, then, illuminating the red or blue illumination elements at the three pixel locations "g," "i" and "p" during the second frame.

As will now be described, the foregoing process can be employed in a passive-matrix color LCD display such that any display neighborhood can have any one of 4096 different colors. To appreciate the process for arriving at this broad choice of colors, it should be first understood that each illumination element (picture sub-element) at each pixel location in a passive-matrix display can have one of two states (i.e., either on or off). Furthermore, each color can be controlled (pursuant to the above-described algorithm) to have one of sixteen different shades. Thus, in the case where the illumination elements have colors red, green and blue, there are choices for any display neighborhood of sixteen shades of red, sixteen shades of green and sixteen shades of blue of each of the eight colors. Any one of the sixteen red shades can be combined with any one of the sixteen green shades—for a total of $16^2$ or 256 shades. Furthermore, any one of those 256 shades can be combined with any one of the sixteen blue shades—for a total of 4096 shades.

In normal practice, a given display neighborhood is not usually uniformly shaded but, instead, the shading is to be varied from pixel-to-pixel within the display neighborhood. As will now be explained, the look-up table of FIG. 3 can, in fact, be applied to all of the display neighborhoods within an image field.

Figure 4:
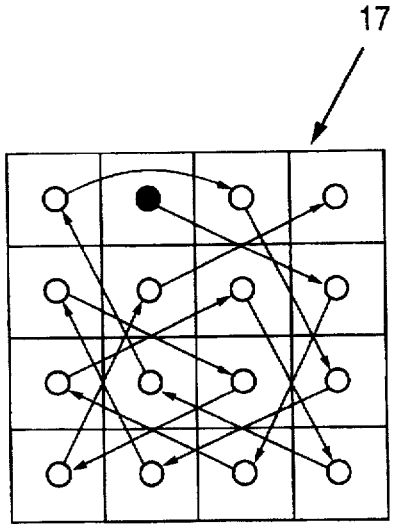
FIG. 4 shows the display neighborhood of FIG. 2 and a preferred pixel transition order within each neighborhood according to the present invention.

FIG. 4 shows an example of a preferred pixel transition order within a display neighborhood. This example is best understood by considering the case where a display neighborhood is to be uniformly shaded with shade #1 (for example red shade #1) according to the look-up table in FIG. 3. In this case the look-up table shows that an illumination element of the single pixel location "b" is illuminated during the first frame of the sixteen-frame sequence; that a corresponding illumination element of the single pixel location "h" is illuminated during the second frame; that the same illumination element of the single pixel location "o" is illuminated during the third frame; and so forth. The same pixel transition order can be seen in FIG. 4 and, in fact, that diagram was used as the basis for constructing the look-up table in FIG. 3.

In FIG. 4, the consecutively illuminated pixel locations are connected by linear vectors $v_1$, $v_2$, and so forth. Thus, vector $v_1$ extends from pixel locations "b" to pixel locations "h"; vector $v_2$ extends from pixel locations "h" to pixel locations "o"; and so forth. Although the direction of the vector changes from frame to frame, all of the vectors have generally the same length. Accordingly, the distances separating consecutively-illuminated pixel locations are generally equal. This concept of providing generally equal separation distance during transitions is important to taking advantage of the visual averaging property. As a result of employing the pixel transition order shown in FIG. 4 to construct the look-up table in FIG. 3, state transitions occur substantially uniformly in space and time within each display neighborhood throughout the array of picture elements during a multi-frame display sequence.

The look-up table of FIG. 3 also determines how pixel illumination sequences are selected when the shading at a given pixel location changes—that is, when the shading at a given pixel location is to be made lighter or darker. As a concrete example, assume that pixel location "p" has shade #1 of one color (for example red) and that a transition from shade #1 to shade #2 is to occur at the beginning of the second frame sequence where each sequence comprises sixteen frames. In that case, when producing shade #1, pixel location "p" is illuminated only in the sixth frame, of the first frame sequence. In making the transition to shade #2, pixel location "p" is not illuminated again until the third frame, of the second frame sequence; then, that pixel location is illuminated again in the eleventh frame, and so forth.

Figure 5:
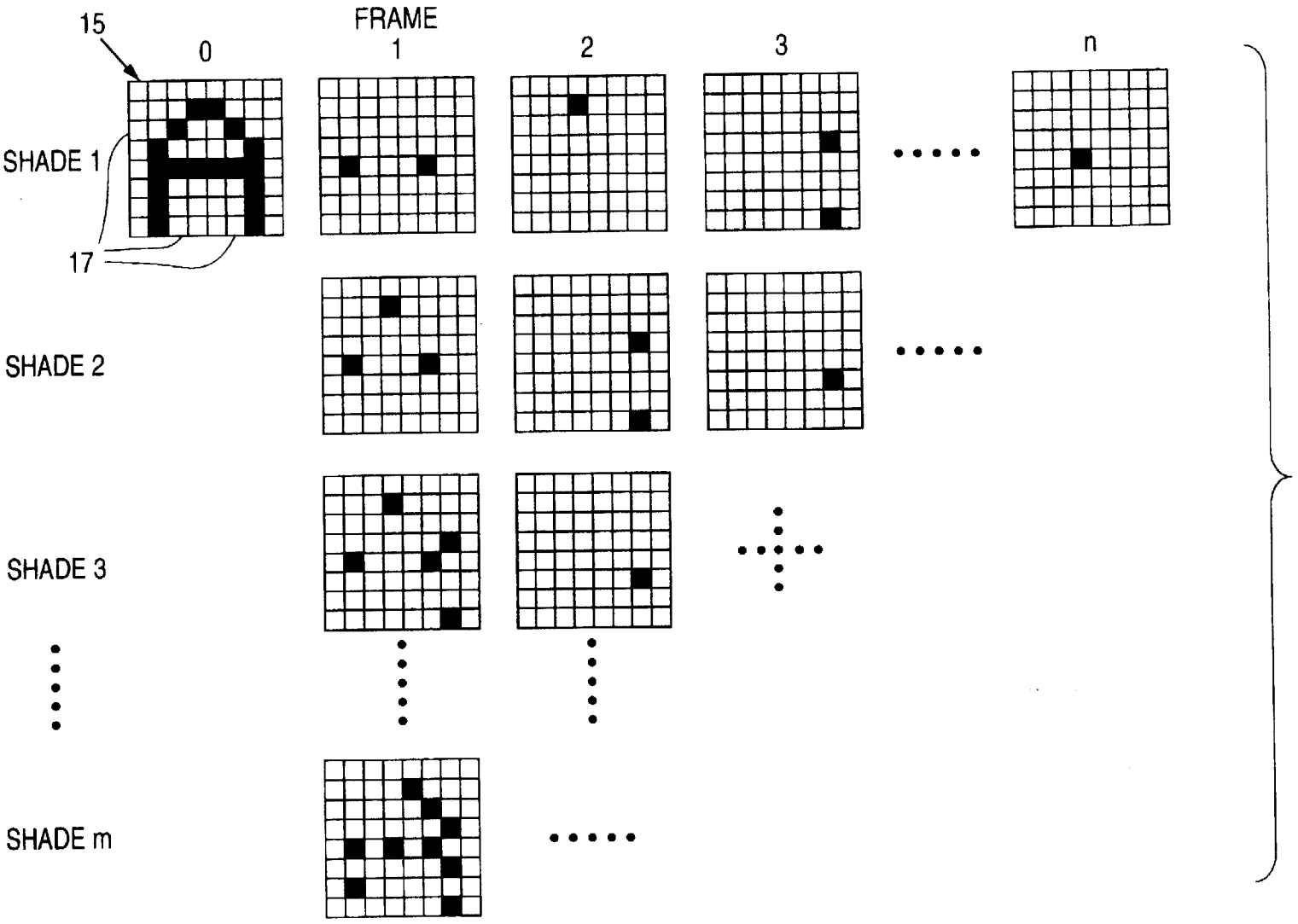
FIG. 5 shows a cluster of four display neighborhoods with the display neighborhoods being drawn to a highly enlarged scale for purpose of further describing the process of the present invention.
Figure 6A:
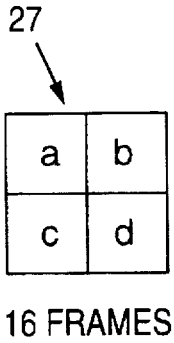
FIGS. 6(*a*)–(*f*) show various states of a display neighborhood 27 which is two pixels wide by two pixels high.
Figure 6D:
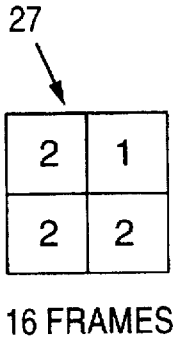
Figure 6B:
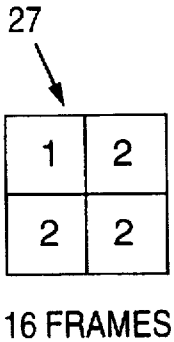
Figure 6E:
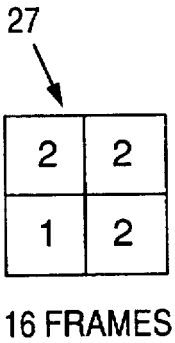
Figure 6C:
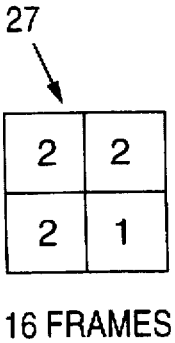
Figure 6F:
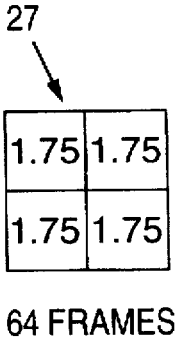
Figure 7A:
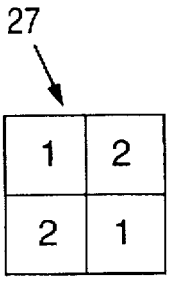
FIGS. 7(*a*)–(*d*) show various states of a display neighborhood 27 which is two pixels wide by two pixels high.
Figure 8A:
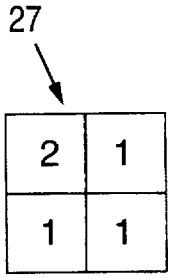
FIGS. 8(*a*)–(*d*) show various states of a display neighborhood 27 which is two pixels wide by two pixels high.
Figure 7B:
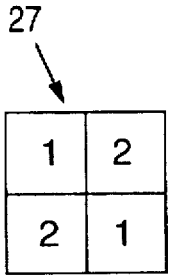
Figure 8B:
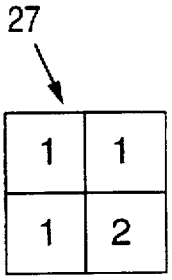
Figure 7C:
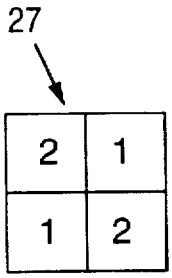
Figure 8C:
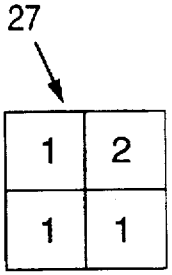
Figure 7D:
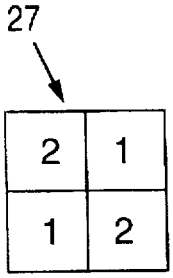
Figure 8D:
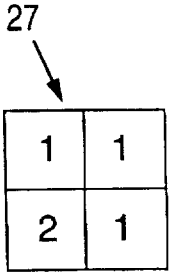

In the preceding example, it was assumed that a transition from one shade to another shade occurred at the beginning of the first frame of the sixteen-frame sequence. In practice, depending on the image which is to be presented, it may be desired to change the shade of a given pixel location at any frame within a sixteen-frame sequence. FIG. 5 shows an example of producing the letter "A" in a cluster of four display neighborhoods. If the letter "A" is to have shade #1 for the first and second frames and then is to be changed to shade #2 on the third frame then the shading for that third frame is determined from the look-up table of FIG. 3. According to this example, only one pixel location would be illuminated during the third frame to initiate the transition to shade #2.

In normal practice, shading is not usually uniform across a display neighborhood but, instead, the shading varies within each display neighborhood. The manner in which the look-up table of FIG. 3 is applied to create the illusion of shading at individual pixel locations is described above. According to that explanation, each picture sub-element of an individual pixel location can have any one of sixteen different color shades. In the following, a dynamic dithering process will be described that results in permitting each picture sub-element of each individual pixel location to have any one of sixty-four different color shades.

One embodiment of the dynamic dithering process can be understood in connection with FIG. 6(*a*) which shows a display neighborhood 27 which is two pixels wide by two pixels high; in other words, display neighborhood 27 is a square that encompasses four pixel locations. For convenience of discussion, the four pixel locations in display neighborhood 27 are labelled as locations "a" through "d".

In FIG. 6(*b*), two consecutive shading numbers are assigned to four contiguous pixel (or pixel sub-element) locations. In this example, pixel location "a" exhibits shade #1, pixel location "b" exhibits shade #2, pixel location "c" exhibits shade #2, and pixel location "d" also exhibits shade #2. Over a first sixteen frame sub-sequence, those pixel locations are illuminated as described above. The average shade perceived by the human eye for the location encompassing the overall area encompassing the four contiguous pixel locations "a" through "d" will be 1.75. The value of this shade is different than either shade #1 or shade #2 and, therefore, the overall area will appear to have a different shade than either shade #1 or shade #2.

In FIG. 6(*c*), different shading numbers are assigned to some of the pixel locations. In this example, pixel location "a" exhibits shade #2, pixel location "b" exhibits shade #2, pixel location "c" exhibits shade #2, and pixel location "d" also exhibits shade #1. Again, those pixel locations are illuminated as described above over a sixteen-frame sequence. And again, the average shade perceived by the human eye for the overall area encompassing the four contiguous pixel locations "a" through "d" will be 1.75.

In FIG. 6(*d*), still different shading numbers are assigned to some of the pixel locations. In this example, pixel location "a" exhibits shade #2, pixel location "b" exhibits shade #1, and pixel locations "c" and "d" both exhibit shade #2. Again, those pixel locations are illuminated as described above over a third sixteen-frame sub-sequence. And again, the average shade perceived by the human eye for the overall area encompassing the four contiguous pixel locations "a" through "d" will be 1.75.

Finally, in FIG. 6(*e*), pixel locations "a" and "b" both exhibit shade #2, pixel location "c" exhibits shade #1, and pixel location "d" exhibits shade #2. Again, those pixel locations are illuminated as described above over a fourth sixteen-frame sub-sequence—with the result that the average shade perceived by the human eye for the overall area encompassing the four contiguous pixel locations is 1.75.

FIG. 6(*f*) shows the sixty-four frame equivalent of the above-described process: namely, pixel locations "a" through "d" all exhibiting a shading value of 1.75. It should now be understood that there are two other ways (i.e., permutations) by which two consecutive shading numbers can be assigned to four contiguous pixel locations. One of those permutations is shown in FIGS. 7(*a*) through 7(*d*), and the other permutation is shown in FIGS. 8(*a*) through 8(*d*). When the pixel locations in those permutations are illuminated as described above over a sixty-four frame sequence, the average shade perceived by the human eye for the overall area encompassing the four contiguous pixel locations in FIGS. 7(*a*) through 7(*d*) is 1.5. Similarly, the average shade perceived by the human eye for the overall area encompassing the four contiguous pixel locations in FIGS. 8(*a*) through 8(*d*) is 1.25.

In total, there are five permutations for assigning two consecutive shading numbers to four contiguous pixel locations. When the four contiguous pixel locations in those permutations are illuminated for the above-described example over a sixteen-frame sequence, the average shades perceived by the human eye have one of the following five values: 1.0, 1.25, 1.5, 1.75, or 2.0. Thus, for the sixteen different shading numbers, forty-eight different intermediate shades can be added by assigning, for each pair of consecutive shading numbers, permutations of those shading numbers to four contiguous pixel locations. Therefore, the total number of possible shades is sixty four.

It should now be understood that the above-described dynamic dithering process can be applied independently to each pixel location. For example: for a first sixteen-frame sub-sequence, the shade #1 can be assigned to pixel location "c"; for a second sixteen-frame sub-sequence, the shade #2 can be assigned; for a third sixteen-frame sub-sequence, the shade #2 can be assigned; and, finally, for a fourth sixteen-frame sub-sequence, the shade #2 can be assigned. For this example, the average shade perceived by the human eye for pixel location "c" is 1.25. Because the dynamic dithering process can be applied to a single pixel location, rather than four contiguous pixel locations, there is no inherent loss of resolution that results from applying the dynamic dithering process. That is, a multi-frame sequence M–N frames (e.g. 4×16=64 frames) in duration is logically divided into M (e.g. 4) sub-sequences each N (e.g. 16) frames in duration with the duty cycle of each picture element during each of the M N-frame sub-sequences being allowed to assume one of two adjacent values only within the set {0, 1/M×N, 2/M×N . . . M×N/M×N}.

Applying the foregoing dithering technique to a passive matrix (e.g., STN) color LCD display, each picture sub-element R, G and B may have 64 shades (instead of 16 shades using frame modulation without dithering) for a total of $64^3$ or approximately 256 thousand possible colors. That is, applying the foregoing dithering technique with M N-frame sub-sequences, each picture sub-element R, G, and B may have M×N shades for a total of $(M\times N)^3$ possible colors.

Applying the same frame modulation and dithering techniques to a typical active-matrix (e.g., TFT) color LCD display, a total of more than sixteen million possible colors may be achieved as will presently be explained. In a typical TFT color LCD display, three inputs are provided for each color R, G and B as follows: $R_0$, $R_1$, $R_2$; $G_0$, $G_1$, $G_2$; and $B_0$, $B_1$, $B_2$. Each picture sub-element R, G or B may therefore exhibit one of $2^3$=8 shades. In accordance with the present invention, $R_0$, $G_0$, and $B_0$, are frame-modulated as explained above such that the least significant input alone selects between 16 display shades. The three input terminals of a given color taken together therefore select between 16×2×2=64 display shades, making possible a total of $64^3$ or 4096 colors. Applying dynamic dithering to the least significant inputs, however, each selects between 64 display shades instead of 16. The three inputs of a given color taken together therefore select between 64×2×2=256 display shades, making possible a total of $256^3$ or more than sixteen million colors. M N-frame sub-sequences may be employed as described above to apply dynamic dithering to the least significant inputs of a color active matrix display, with three inputs provided for each picture sub-element. In this case, each least significant input selects between M×N shades instead of N. The three inputs of a given color taken together therefore select between (M×N)×2×2 display shades, making possible a total of $[(M\times N)\times 2\times 2]^3$ colors.

It can now be understood that the present invention provides a method of simulating display shades on a display device, such as monochrome LCD panel or the like, that does not intrinsically provide display shades. Furthermore, the same method may be used in conjunction with display devices that do provide display shades to dramatically increase the number of possible display shades or colors. More particularly, the present invention provides a method for realizing a smooth display that effectively convinces the human eye and the human mind to perceive a variety of display shades. Thus, in use of the present invention, no individual state transitions, which by themselves constitute only display noise, are perceived; instead, a coherent pattern of state transitions blending is seen that effectively simulates a shaded image display.

What is claimed is:

1. In a color display apparatus having an array of picture elements each including plural picture sub-elements each of a different color and each having more than two display states selected between using at least two input terminals, each of which has two possible inputs, an ON input and an OFF input, a method of simulating display colors in addition to a number of display colors otherwise available using said color display apparatus, comprising the steps of:

modulating an ON/OFF duty cycle of a least significant one of said at least two input terminals of each picture sub-element of the array of picture elements during a multi-frame display sequence according to attribute information of respective picture element data to be displayed; and coordinating the timing of ON/OFF and OFF/ON input transitions on said least significant input terminal of each picture sub-element within each of a plurality of predetermined display neighborhoods throughout the array of picture elements such that said input transitions cause state transitions of said picture sub-elements to occur substantially uniformly in space and time, within each display neighborhood, during the multi-frame display sequence wherein said color display apparatus is a thin-film transistor LCD display, wherein each picture element has at least eight display states selected between using at least three input terminals, wherein said multi-frame sequence is 64 frames long and is logically divided into four sub-sequences each 16 frames long, wherein 260 shades of each picture sub-element are realized by causing the ON/OFF duty cycle of said least significant input terminal of each picture sub-element to have a value within the set {0, 1/64, 2/64, . . . , 64/64}, and wherein the ON/OFF duty cycle of said least significant input terminal of each picture sub-element during each of said four 16-frame sub-sequences of said 64 frame sequence is caused to have a value within the set {0, 1/16, 2/16, . . . , 16/16}.

2. The method of claim 1 comprising the further step of allowing the ON/OFF duty cycle of said least significant input terminal of each picture sub-element during each of said four 16-frame sub-sequences of said 64 frame sequence to assume one of two adjacent values only within the set {0, 1/16, 2/16, . . . , 16/16}.

3. The method of claim 1 comprising the further step of allowing the ON/OFF duty cycle of said least significant input terminal of each picture sub-element during at least one, but not all, of said four 16-frame sub-sequences of said 64 frame sequence to assume only a first of two adjacent values within the set {0, 1/16, 2/16, . . . , 16/1} and allowing the duty cycle of said least significant input terminal of each picture sub-element during the others of said four 16-frame sequences to assume only a second of said two adjacent values.

4. In a color display apparatus having an array of picture elements each including plural picture sub-elements each of a different color and each having more than two display states selected between using at least two input terminals, each of which has two possible inputs, an ON input and an OFF input, a method of simulating display colors in addition to a number of display colors otherwise available using said color display apparatus, comprising the steps of:

modulating an ON/OFF duty cycle of a least significant one of said at least two input terminals of each picture sub-element of the array of picture elements during a multi-frame display sequence according to attribute information of respective picture element data to be displayed; and coordinating the timing of ON/OFF and OFF/ON input transitions on said feast significant input terminal of each picture sub-element within each of a plurality of predetermined display neighborhoods throughout the array of picture elements such that said input transitions cause state transitions of said picture sub-elements to occur substantially uniformly in space and time, within each display neighborhood, during the multi-frame display sequence wherein said color display apparatus is a thin-film transistor LCD display, wherein each picture element has at least eight display states selected between using at least three input terminals, wherein said multi-frame sequence is M×N frames long, M and N being integers, and is logically divided into M sub-sequences each N frames long, wherein M×N+1 shades of each picture sub-element are realized by causing the ON/OFF duty cycle of said least significant input terminal of each picture sub-element to have a value within the set {0, 1/M×N, 2/M×N, M×N/M×N}, and wherein the ON/OFF duty cycle of said least significant input terminal of each picture sub-element during each of said M N-frame sub-sequences of said M×N frame sequence is caused to have a value within the set {0, 1/N, 2/N, . . . , N/N}.

5. The method of claim 4 comprising the further step of allowing the duty cycle of said least significant input terminal of each picture sub-element during each of said M N-frame subsequences of said M×N frame sequence to assume one of two adjacent values only within the set {0, 1/N, 2/N, N/N}.

6. The method of claim 4 comprising the further step of allowing the duty cycle of said least significant input terminal of each picture sub-element during at least one, but not all, of said M N-frame sub-sequences of said M×N frame sequence to assume only a first of two adjacent values within the set {0, 1/N, 2/N, . . . , N/N} and allowing the duty cycle of said least significant input terminal of each picture sub-element during the others of said M N-frame sub-sequences to assume only a second of said two adjacent values.

7. A method of simulating display colors in addition to a number of display colors otherwise available using a color display device that has an array of picture elements each including plural picture sub-elements each of a different color and each having only two display states, an ON state and an OFF state, comprising the steps of:

modulating an ON/OFF duty cycle of each picture sub-element of the array of picture elements during a multi-frame display sequence according to attribute information of respective picture element data to be displayed; and coordinating the timing of ON/OFF and OFF/ON state transitions of picture sub-elements within each of a plurality of predetermined display neighborhoods throughout the array of picture elements such that the state transitions occur substantially uniformly in space and time, within each display neighborhood, during the multi-frame display sequence wherein said multi-frame sequence is sixty-four frames long, wherein said multi-frame sequence sixty-four frames long is logically divided into four sub-sequences each sixteen frames long, wherein sixty-five display shades of each picture sub-element are realized by causing the ON/OFF duty cycle of each picture element to have a value within the set {0, 1/64, 2/64, . . . , 64/64}, and wherein the ON/OFF duty cycle of each picture sub-element during each of said four sixteen-frame sub-sequences of said sixty-four-frame sequence is caused to have a value within the set {0, 1/16, 2/16, . . . , 16/16}.

8. The method of claim 7 comprising the further step of allowing the duty cycle of each picture sub-element during each of said four sixteen-frame sub-sequences of said sixty-four-frame sequence to assume one of two adjacent values only, within the set {0, 1/16, 2/16, . . . , 16/16}.

9. The method of claim 7 comprising the further step of allowing the duty cycle of each picture sub-element during at least one, but not all, of said four sixteen-frame sub-sequences of said sixty-four-frame sequence to assume only a first of two adjacent values within the set {0, 1/16, 2/16, . . . , 16/16} and allowing the duty cycle of each picture element during the others of said four sixteen-frame sub-sequences of said sixty-four-frame sequence to assume only a second of said two adjacent values.

10. A method of simulating display colors in addition to a number of display colors otherwise available using a color display device that has an array of picture elements each including plural picture sub-elements each of a different color and each having only two display states, an ON state and an OFF state, comprising the steps of:

modulating an ON/OFF duty cycle of each picture sub-element of the array of picture elements during a multi-frame display sequence according to attribute information of respective picture element data to be displayed; and coordinating the timing of ON/OFF and OFF/ON state transitions of picture sub-elements within each of a plurality of predetermined display neighborhoods throughout the array of picture elements such that the state transitions occur substantially uniformly in space and time, within each display neighborhood, during the multi-frame display sequence wherein said multi-frame sequence is M×N frames long, M and N being integers, and is logically divided into M sub-sequences each N frames long, wherein M×N+1 display shades of each picture sub-element are realized by causing the ON/OFF duty cycle of each picture sub-element to have a value within the set {0, 1/M×N, 2/M×N, . . . , M×N/M×N}, and wherein the ON/OFF duty cycle of each picture sub-element during each of said M N-frame sub-sequences of said M×N frame sequence is caused to-have a value within the set {0, 1/N, 2/N, . . . , N/N}.

11. The method of claim 10, comprising the further step of allowing the duty cycle of each picture sub-element during each of said M N-frame sub-sequences of said M×N frame sequence to assume one of two adjacent values only, within the set {0, 1/M, 2/M . . . M/M}.

12. The method of claim 10, comprising the further step of allowing the duty cycle of each picture sub-element during at least one, but not all, of said M-frame sub-sequences of said M×N frame sequence to assume only a first of two adjacent values within the set {0, 1/M, 2/M . . . M/M} and allowing the duty cycle of each picture sub-element during the other of said M N-frame sub-sequences of said M×N frame sequence to assume only a second of said two adjacent values.

13. A color display apparatus having an array of picture elements each including plural picture sub-elements each of a different color and each having more than two display states selected between using at least two input terminals, each of which has two possible inputs, an ON input and an OFF input, said apparatus comprising:

modulating means for modulating an ON/OFF duty cycle of a least significant one of said at least two input terminals of each picture sub-element of the array of picture elements during a multi-frame display sequence according to attribute information of respective picture element data to be displayed; and coordinating means for coordinating the timing of ON/OFF and OFF/ON input transitions on said least significant input terminal of each picture sub-element within each of a plurality of predetermined display neighborhoods throughout the array of picture elements such that said input transitions cause state transitions of said picture sub-elements to occur substantially uniformly in space and time, within each display neighborhood, during the multi-frame display sequence whereby said color display apparatus simulates display colors in addition to a number of display colors that would otherwise be available using said color display apparatus wherein said color display apparatus has a thin-film transistor LCD display, wherein each picture element has at least eight display states selected between using at least three input terminals, wherein said multi-frame sequence is 64 frames long and is logically divided into four sub-sequences each 16 frames long, wherein 260 shades of each picture sub-element are realized by causing the ON/OFF duty cycle of said least significant input terminal of each picture sub-element to have a value within the set {0, 1/64, 2/64, . . . , 64/64}, wherein the ON/OFF duty cycle of said least significant input terminal of each picture sub-element during each of said four 16-frame sub-sequences of said 64 frame sequence is caused to have a value within the set {0, 1/16, 2/16, . . . , 16/16}.

14. The apparatus of claim 13, further comprising:

means for allowing the ON/OFF duty cycle of said least significant input terminal of each picture sub-element during each of said four 16-frame sub-sequences of said 64 frame sequence to assume one of two adjacent values only within the set {0, 1/16, 2/16, . . . , 16/16}.

15. The apparatus of claim 13, further comprising:

means for allowing the ON/OFF duty cycle of said least significant input terminal of each picture sub-element during at least one, but not all, of said four 16-frame sub-sequences of said 64 frame sequence to assume only a first of two adjacent values within the set {0, 1/16, 2/16, . . . , 16/1} and allowing the ON/OFF duty cycle of said least significant input terminal of each picture sub-element during the others of said four 16-frame sub-sequences of said 64 frame sequence to assume only a second of said two adjacent values.

16. A color display apparatus having an array of picture elements each including plural picture sub-elements each of a different color and each having more than two display states selected between using at least two input terminals, each of which has two possible inputs, an ON input and an OFF input, said apparatus comprising:

modulating means for modulating an ON/OFF duty cycle of a least significant one of said at least two input terminals of each picture sub-element of the array of picture elements during a multi-frame display sequence according to attribute information of respective picture element data to be displayed; and coordinating means for coordinating the timing of ON/OFF and OFF/ON input transitions on said least significant input terminal of each picture sub-element within each of a plurality of predetermined display neighborhoods throughout the array of picture elements such that said input transitions cause state transitions of said picture sub-elements to occur substantially uniformly in space and time, within each display neighborhood, during the multi-frame display sequence whereby said color display apparatus simulates display colors in addition to a number of display colors that would otherwise be available using said color display apparatus wherein said color display apparatus has a thin-film transistor LCD display, wherein each picture element has at least eight display states selected between using at least three input terminals, wherein said multi-frame sequence is M×N frames long, M and N being integers, and is logically divided into M sub-sequences each N frames long, wherein M×N+1 shades of each picture sub-element are realized by causing the ON/OFF duty cycle of said least significant input terminal of each picture sub-element to have a value within the set {0, 1/M×N, 2/M×N, M×N/M×N}, wherein the ON/OFF duty cycle of said least significant input terminal of each picture sub-element during each of said M N-frame sub-sequences of said M×N frame sequence is caused to have a value within the set {0, 1/N, 2/N, . . . , N/N}.

17. The apparatus of claim 16 further comprising:

means for allowing the duty cycle of said least significant input terminal of each picture sub-element during each of said M N-frame sub-sequences of said M×N frame sequence to assume one of two adjacent values only within the set {0, 1/N, 2/N, . . . , N/N}.

18. The apparatus of claim 16 further comprising:

means for allowing the duty cycle of said least significant input terminal of each picture sub-element during at least one, but not all, of said M N-frame sub-sequences of said M×N frame sequence to assume only a first of two adjacent values within the set {0, 1/N, 2/N, . . . . N/N} and means for allowing the duty cycle of said least significant input terminal of each picture sub-element during the other of said M N-frame sub-sequences of said M×N frame sequence to assume only a second of said two adjacent values.

19. A color display apparatus having an array of picture elements each including plural picture sub-elements each of a different color and each having only two display states, an ON state and an OFF state, comprising:

modulating means for modulating an ON/OFF duty cycle of each picture sub-element of the array of picture elements during a multi-frame display sequence according to attribute information of respective picture element data to be displayed; and coordinating means for coordinating the timing of ON/OFF and OFF/ON state transitions of picture sub-elements within each of a plurality of predetermined display neighborhoods throughout the array of picture elements such that the state transitions occur substantially uniformly in space and time, within each display neighborhood, during the multi-frame display sequence whereby said color display apparatus simulates display colors in addition to a number of display colors otherwise available using said color display apparatus wherein said multi-frame sequence is sixty-four frames long and is logically divided into four sub-sequences each sixteen frames long, wherein sixty-five display shades of each picture sub-element are realized by causing the ON/OFF duty cycle of each picture element to have a value within the set {0, 1/64, 2/64, . . . , 64/64}, and wherein the ON/OFF duty cycle of each picture sub-element during each of said four sixteen-frame sub-sequences of said sixty-four-frame sequence is caused to have a value within the set {0, 1/16, 2/16, . . . . , 16/16}.

20. The apparatus of claim 19 further comprising:

means for allowing the duty cycle of each picture sub-element during each of said four sixteen-frame sub-sequences of said sixty-four-frame sequence to assume one of two adjacent values only, within the set {0, 1/16, 2/16, . . . , 16/16}.

21. The apparatus of claim 19 further comprising:

means for allowing the duty cycle of each picture sub-element during at least one, but not all, of said four sixteen-frame sub-sequences of said sixty-four-frame sequence to assume only a first of two adjacent values within the set {0, 1/16, 2/16, . . . . 16/16} and means for allowing the duty cycle of each picture sub-element during the other of said four sixteen-frame sub-sequences of said sixty-four-frame sequence to assume a second of said two adjacent values.

22. A color display apparatus having an array of picture elements each including plural picture sub-elements each of a different color and each having only two display states, an ON state and an OFF state, comprising:

modulating means for modulating an ON/OFF duty cycle of each picture sub-element of the array of picture elements during a multi-frame display sequence according to attribute information of respective picture element data to be displayed; and coordinating means for coordinating the timing of ON/OFF and OFF/ON state transitions of picture sub-elements within each of a plurality of predetermined display neighborhoods throughout the array of picture elements such that the state transitions occur substantially uniformly in space and time, within each display neighborhood, during the multi-frame display sequence whereby said color display apparatus simulates display colors in addition to a number of display colors otherwise available using said color display apparatus wherein said multi-frame sequence is M×N frames long, M and N being integers, and is logically divided into M sub-sequences each N frames long, wherein M×N+1 display shades of each picture sub-element are realized by causing the ON/OFF duty cycle of each picture sub-element to have a value within the set {0, 1/M×N, 2/M×N, . . . , M×N/M×n}, and wherein the ON/OFF duty cycle of each picture sub-element during each of said M N-frame sub-sequences of said M×N frame sequence is caused to-have a value within the set {0, 1/N, 2/N, . . . , N/N}.

23. The apparatus of claim 22, further comprising:

means for allowing the duty cycle of each picture sub-element during each of said M N-frame subsequences of said M×N frame sequence to assume one of two adjacent values only, within the set {0, 1/M, 2/M . . . M/M}.

24. The apparatus of claim 22, further comprising:

means for allowing the duty cycle of each picture sub-element during each of said M N-frame sub-sequences of said M×N frame sequence to assume only a first of two adjacent values within the set {0, 1/M, 2/M . . . M/M} and means for allowing the duty cycle of each picture sub-element during a second of said M N-frame sub-sequences of said M×N frame sequence to assume only a second of said two adjacent values.

* * * * *